US005122009A

United States Patent [19]

Vivier

[11] Patent Number: 5,122,009

[45] Date of Patent: Jun. 16, 1992

[54] HIGHWAY STRUCTURE SEALING COMPLEX AND PROCESS FOR ITS APPLICATION

[75] Inventor: Maurice Vivier, Paris, France

[73] Assignee: Enterprise Jean Lefebvre, Neuilly-sur-Seine, France

[21] Appl. No.: 698,303

[22] Filed: May 10, 1991

[30] Foreign Application Priority Data

May 14, 1990 [FR] France ..... 90 05988

[51] Int. Cl.[5] ..... C08L 31/00

[52] U.S. Cl. ..... 404/31; 404/32

[58] Field of Search ..... 404/31, 32, 17, 81, 404/82; 106/273.1, 276, 277; 427/136, 138, 139, 203, 204

[56] References Cited

U.S. PATENT DOCUMENTS 4,728,683 3/1988 Smits et al. ..... 404/31 X 4,863,308 9/1989 Stotzel ..... 404/31

*Primary Examiner*—Thuy M. Bui

[57] ABSTRACT

The invention relates to a highway structure sealing complex and a process for its application.

The sealing complex comprises:

a lower course of hot bituminous mix, consisting of a bituminous binder and a granulate, the bituminous binder representing from approximately 8.5 to approximately 10.5 parts by weight per 100 parts by weight of granulate, an intermediate course consisting essentially of a bituminous binder, an upper course of cold-cast bituminous mix.

Such a leakproof complex exhibits a high capability of avoiding the propagation of ascending or descending cracks.

11 Claims, No Drawings

HIGHWAY STRUCTURE SEALING COMPLEX AND PROCESS FOR ITS APPLICATION

The present invention relates to a highway structure sealing complex and to a process for leakproof surfacing of a highway structure floor.

A number of techniques permit highway structures to be sealed. Among these, there may be mentioned the spreading of asphalt and the spreading of a thin film, for example of epoxy pitch type, adhering to the concrete floor of the highway structure. The use of prefabricated membranes also allows a sealed device to be produced. A common feature of these materials is fairly low yields. In addition, they are sensitive to atmospheric changes when being applied.

The sealing of a conventional highway structure, for example a bridge, with the aid of one of these techniques is relatively long to carry out, and thus delays bringing the structure into service. In addition, these techniques do not always make it possible to employ conventional road building equipment, such as spreaders, and they require additional equipment as well as considerable manpower.

A solution has been provided by the invention described in French Patent Application No. 87/05,435. It relates to a highway structure sealing complex which is chiefly intended to receive a surfacing course, characterized in that it comprises:

a hot-bituminous mix lower course consisting of a mortar comprising approximately 11 to approximately 16% of granulate of a diameter smaller than 80 μm and of approximately 8.5 to approximately 10.5% of a bituminous binder based on elastomers, the percentages being expressed by weight relative to the dry granulate, an intermediate course consisting of an elastomer-rich asphalt.

A disadvantage of this type of sealing complex is that, when the first carpet of hot bituminous mix (forming the surfacing course) is placed on the bituminous intermediate course, even when sanded, the latter melts and percolates from the bottom upwards to the base of this carpet, with the result that its thickness greatly diminishes until it virtually completely disappears if the temperature of the bituminous mix is excessive. The ability to avoid the propagation of ascending or descending cracks is then greatly lessened, because a carpet of bituminous mix, even when highly enriched in bituminous binder at its base, is obviously less deformable than a course of pure binder.

The present invention is aimed at overcoming this disadvantage and improving the sealing of the complex of U.S. Pat. No. 4,863,308, particularly useful in the case of highway structures subjected to great thermal stresses, especially in the case of highway structures in high mountains.

The highway structure sealing complex according to the invention comprises:

a lower course of hot-bituminous mix comprising, per 100 parts of granulate, from approximately 8.5 to approximately 10.5% of a bituminous binder containing elastomers, approximately 11 to approximately 16% by weight of the granulate which has a diameter of less than 80 μm, an intermediate course consisting essentially of a bituminous binder, an upper course of cold-cast bituminous mix.

The upper course of cold-cast bituminous mix consists of a bituminous binder in the form of emulsion and a granulate whose maximum particle size remains smaller than approximately 10 mm.

The cold-cast bituminous mix of the upper course contains from approximately 6 to approximately 20 parts of residual binder, per 100 parts by weight of granulate.

The granulate of the upper course of cold-cast bituminous mix is preferably a crushed sand. The upper course of cold-cast bituminous mix consists of a heat shield preventing any rising of the bituminous binder from the intermediate course into the first carpet of hot bituminous mix applied onto the complex. The upper course of cold-cast bituminous mix can be in the form of a single course or of a twin course. In the case of a single course the granulate is preferably 0/6 or 0/10 continuous chipping. In the case of a twin course, a 0/4 or 0/6 continuous sand or a 0/6 discontinous sand is preferably employed.

When the upper course of cold-cast bituminous mix forms the surfacing course, a 0/6 or 0/10 discontinuous particle size range, or else a 0/10 continuous particle size range, is preferably employed.

The thickness of the course of cold-cast bituminous mix is advantageously between 3 and 12 mm. It is essentially a function of the particle size of the sand. Thus, in the case of a 0/2 sand, the thickness is of the order of 3 to 5 mm; in the case of a 0/4 sand, it is from 5 to 7 mm; in the case of a 0/6 sand it is from 7 to 10 mm.

A filler may optionally supplement the particle size of the granulates, such as, for example, a ground rock powder, preferably limestone, cement, natural or artificial rock fibers or organic fibers. The filler content is less than 10% by weight relative to the granulate. The bituminous binder of the upper course of cold-cast bituminous mix contains essentially an asphalt. The asphalt may be chosen from pure asphalts, preferably from asphalts of 60/70 and 80/100 grades. The asphalt employed may also be an asphalt modified by the addition of thermoplastic copolymers, or by direct hot mixing of pure asphalt and of copolymers, or by indirect cold mixing of pure asphalt emulsion and of an aqueous dispersion of copolymers at the time of manufacture of the bituminous mix to be cast. Ethylene-vinyl acetate (EVA) or styrene-butadiene-styrene triblock (SBS) or ethylenemethacrylate (EMA) copolymers are preferably employed. However, it will also be possible to employ two-block styrene butadiene rubber (SBR) copolymers and acrylic copolymers, as well as various mixtures of these copolymers. The copolymer content does not exceed approximately 5% by weight. The addition of such copolymers results in a decreased wastage when brought into use, a better binder-granulate bond, an increased salt water resistance, a reduction in the sensitivity to heat and to old, higher cohesion and better deformability.

In an alternative form of the invention the bituminous binder of the upper course of cold-cast bituminous mix additionally contains synthetic fibers. The fibers employed are synthetic organic fibers which are ultrafine (a few decitex) and relatively long (4 to 8 mm). They are chosen as a function of the elastic modulus of the material of which they are made, so as to obtain a fibrous bituminous mix whose deformability is compatible with that of the substrate onto which it will be applied. Low-modulus fibers will be employed for the most deformable structures. The proportion of fibers is advantageously between 0.05 and 3% by weight. This proportion may be very low but, bearing in mind the extreme fineness of these fibers, their number per square meter of cast bituminous mix is considerable, as is the length of the network which they form. The addition of fibers to the bituminous binder is particularly desirable when this binder contains a granulate whose particle size range is discontinuous.

The granulate of the lower course of hot bituminous mix may consist, for example, of a mixture of crushed or ground sand of 0–2 particle size, of round sand of 0–2 to 0–4 particle size and of crushed sand of 2–4 particle size. A mortar of 0–2 particle size or a microsand-gravel mixture of 0–6 particle size may be employed.

The bituminous binder employed for the lower course of hot bituminous mix may be chosen from the bituminous binders described above in the case of the upper course of cold-cast bituminous mix. From approximately 8 to approximately 11 parts by weight of binder are preferably employed per 100 parts by weight of granulate.

The thickness of the lower course of hot bituminous mix will be preferably between approximately 2 and approximately 4 cm.

This first course makes it possible to obtain the reprofiling of the structure to be covered and to ensure a first sealing. A mortar of the type described above has a compactness of 96 to 98%. Permeability tests have been carried out with the aid of an EDF permeameter. The coefficient is lower than $10^{-12}$ meters/second. This course is therefore sealed leakproof.

The bituminous binder of the intermediate course contains essentially an asphalt. The asphalt may be chosen from pure asphalts, preferably from hard-grade asphalts, for example of 40/50 or 20/30 or 10/20 grade. The asphalt may be advantageously an asphalt modified by the addition of a macromolecular compound, for example an ethylene-vinyl acetate (EVA) copolymer or a styrene-butadiene-styrene (SBS) copolymer. However, it will also be possible to employ two-block styrene-butadiene rubber copolymers and acrylic copolymers and various mixtures of these copolymers. The maximum copolymer content is imposed by the limiting viscosity of the modified asphalt up to which it flows through a heated and lagged spray bar while remaining at a temperature below the decomposition temperature of the copolymer.

The bituminous binder of the intermediate course of the complex may additionally comprise a resin in proportions ranging from approximately 1 to approximately 10% by weight. Resins which are particularly preferred are terpene resins.

The thickness of the bituminous membrane is advantageously between 1 and 5 mm, which corresponds approximately to 1 to 5 kg/m$^2$ of binder.

The bituminous membrane may be advantageously surfaced, in a conventional manner, during a sanding operation, with fine particles, for example with crushed slate or with sandstone grit.

The present invention also relates to a process for leakproof surfacing of a highway structure floor, in which the following operations are carried out:

(a) a cold impregnating varnish or a priming course containing a special asphalt-elastomer emulsion is spread directly onto the floor of the highway structure, (b) the lower course and then the intermediate course of the sealing complex in accordance with the present invention are spread successively, (c) sanding of the surface of the said complex is optionally carried out, (d) a course of cold-cast bituminous mix is spread.

According to a particular feature, following stage a) the sealing of the edges and other raised places of the said highway structure is carried out by veneering a prefabricated material of conventional type, against the said edges, as springing or with entry, said lower course of the sealing complex is spread while a shrinkage in relation to the said edges is provided, the space thus created during the application of said intermediate course is filled in.

The use of elastomers makes it possible to endow the complex with better cohesion, better elasticity and better adhesiveness to the substrate. In addition, the fact of employing the same elastomers in at least two courses out of three makes it possible to limit the number of raw materials and thereby to make it easier to produce the complex.

The following examples illustrate the three courses of the sealing complex according to the invention without any ligitation being implied.

EXAMPLE 1

Composition for the upper course of cold-cast bituminous mix.

The bituminous binder employed was Mobilplast ® marketed by the Applicant, containing 95% by weight of emulsifiable 80/100 asphalt and 5% by weight of an EVA copolymer.

An emulsion was prepared, of the following composition, expressed in kg:

| | |
|---|---|
| Mobilplast ® binder | 600 |
| Emulsifying agent | 9 |
| HCl (d - 1.19) | 2.15 |
| Water | 400 |

The following characteristic of this emulsion are as follows:

| | |
|---|---|
| pH | 2 to 3.5 |
| Engler viscosity | 2 to 6 degrees |
| oversize on a screen of | |
| 0.630 mm | <0.1% |
| 0.160 mm | <0.25% |
| LCPC rupture index | >160 |
| median diameter | 2 to 4 μm |
| sedimentation at 7 days | <5% |

The composition intended to form the course of cold-cast bituminous mix was prepared by blending the following mixture, in which the properties are expressed in parts by weight:

| | | |
|---|---|---|
| mineral mixture | | 100 parts |
| 0/2 mm crushed sand | 99% by weight | |
| CPA 55 cement | 1% by weight | |
| wetting water | | 7.5 |
| 60% emulsion | | 25 |
| pure dope | | 0.2 |
| polyester fibers | | 0.2 |
| residual binder | | 15 |

EXAMPLE 2

Composition for the upper course of cold-cast bituminous mix.

The emulsion prepared in Example 1 was employed and the following composition was prepared in the same way as in Example 1:

| | | |
|---|---|---|
| mineral mixture | | 100 parts |
| 2/4 mm crushed sand | 34% by weight | |
| 0/2 mm crushed sand | 65% by weight | |
| CPA 55 | 1% by weight | |
| wetting water | | 8 |
| 60% emulsion | | 20 |
| pure dope | | 0.2 |
| polyester fibers | | 0.2 |
| residual binder | | 12 |

EXAMPLE 3

Composition for the intermediate bituminous course

| | |
|---|---|
| 20/30 asphalt approximately | 80% (by weight) |
| EVA copolymer | <20% (by weight) |
| dope | 0.02 to 0.05% (by weight) |

EXAMPLE 4

Other composition for the upper course of cold-cast bituminous mix.

The bituminous binder employed was Mobilplast ® marketed by the Applicant, containing 97% by weight of emulsifiable 80/100 asphalt and 3% by weight of an EVA copolymer.

An emulsion was prepared, of the following composition, expressed in kg:

| | |
|---|---|
| Mobilplast ® binder | 600 |
| Emulsifying agent | 9 |
| HCl (d - 1.19) | 2.15 |
| Water | 400 |

The composition intended to form the course of cold-cast bituminous mix was prepared by blending the following mixture, in which the proportions are expressed in parts by weight:

| | | |
|---|---|---|
| mineral mixture | | 100 parts |
| 0/6 mm crushed | 99% by weight | |
| CPA 55 cement | 1% by weight | |
| wetting water | | 6.5 |
| 60% emulsion | | 13 |
| pure dope | | 0.2 |
| polyester fibers | | 0.2 |
| residual binder | | 7 |

EXAMPLE 5

Composition for the lower course of hot bituminous mix.

This was prepared by blending the following mixture, in which the proportions are expressed in parts by weight:

| | | |
|---|---|---|
| mineral mixture | | 100 parts |
| 2/4 mm crushed sand | 25% by weight | |
| 0/2 mm crushed sand | 55.5% by weight | |

-continued

| | | |
|---|---|---|
| 0/4 mm round sand | 15% by weight | |
| deposit filler | 4.5% by weight | |
| binder | | 9.6 parts |

The binder itself is made up as follows:

| | |
|---|---|
| 80/100 asphalt | approximately 90% |
| EVA copolymer | <10% |
| dope | 0.02 to 0.05% |

EXAMPLE 6

Composition for the lower course of hot bituminous mix

The composition intended to form the lower course of hot bituminous mix was prepared by blending the following mixture, in which the proportions are expressed in parts by weight:

| | | |
|---|---|---|
| mineral mixture | | 100 parts |
| 2/4 crushed sand | 15% by weight | |
| 0/2 crushed sand | 70% | |
| 0/5 round sand | 15% | |
| binder | | 9.7 parts |

The binder itself is made up of:

| | |
|---|---|
| 80/100 asphalt | approximately 90% by weight |
| EVA copolymer | 10% |
| dope | 0.02 to 0.05% |

I claim:

1. A highway structure floor sealing complex, which comprises:

a lower course of hot bituminous mix comprising, per 100 parts of granulate, from approximately 8.5 to approximately 10.5% of a bituminous binder containing elastomers, and from approximately 11 to approximately 16% by weight of granulate which has a diameter of less than 80 μm, an intermediate course consisting essentially of a bituminous binder, and an upper course of cold-cast bituminous mix.

2. A sealing complex as claimed in claim 1, wherein the cold-cast bituminous mix of the upper course consists of a bituminous binder in the form of emulsion and a granulate whose maximum particle size is smaller than approximately 10 mm.

3. A sealing complex as claimed in claim 2, wherein the granulate of the upper course is chosen from crushed sands.

4. A sealing complex as claimed in claim 1, wherein the cold-cast bituminous mix of the upper course contains from approximately 6 to approximately 20 parts by weight of residual binder per 100 parts by weight of granulate.

5. A sealing complex as claimed in claim 1, wherein the bituminous binder of the bituminous mix of the lower course and/or of the upper course contains essentially a pure asphalt.

6. A sealing complex as claimed in claim 1, wherein the bituminous binder of the bituminous mix of the lower course and/or of the upper course contains essentially an asphalt modified by the addition of thermoplastic copolymers.

7. A sealing complex as claimed in claim 1, wherein the bituminous binder of the bituminous mix of the lower course and/or of the upper course additionally contains synthetic organic fibers.

8. A sealing complex as claimed in claim 1, wherein the bituminous binder of the intermediate course contains essentially a pure asphalt.

9. A sealing complex as claimed in claim 1, wherein the bituminous binder of the intermediate course contains essentially an asphalt modified by the addition of thermoplastic copolymers.

10. A sealing complex as claimed in claim 1, wherein the bituminous binder of the intermediate course contains from 1 to 10% by weight of a resin.

11. A sealing complex as claimed in claim 10, wherein the resin is a terpene resin.

* * * * *

UNITED STATES PATENT AND TRADEMARK OFFICE

CERTIFICATE OF CORRECTION

PATENT NO. : 5,122,009

DATED : June 16, 1992

INVENTOR(S) : Maurice Vivier

It is certified that error appears in the above-identified patent and that said Letters Patent is hereby corrected as shown below:

On the title page:

Item [73]: Assignee replace "Enterprise Jean Lefebvre with --Entreprise Jean Lefebvre--.

Signed and Sealed this

Twenty-first Day of September, 1993

Bruce Lehman

*Attest:*

BRUCE LEHMAN

*Attesting Officer*

*Commissioner of Patents and Trademarks*